United States Patent [19]

Visek

[11] Patent Number: 4,784,089

[45] Date of Patent: Nov. 15, 1988

[54] COOLING SYSTEM FOR A WATER-COOLED INTERNAL COMBUSTION ENGINE

[75] Inventor: Tomas Visek, Steyr, Austria

[73] Assignee: Steyr-Daimler-Puch AG, Vienna, Austria

[21] Appl. No.: 128,042

[22] Filed: Dec. 3, 1987

[30] Foreign Application Priority Data

Dec. 11, 1986 [AT] Austria ..... 3289/86

[51] Int. Cl.[4] ..... F01P 3/20

[52] U.S. Cl. ..... 123/41.51; 123/41.27

[58] Field of Search ..... 123/41.02, 41.15, 41.27, 123/41.51; 440/88; 165/104.27, 104.32

[56] References Cited

U.S. PATENT DOCUMENTS

| | | | |
|---|---|---|---|
| 1,907,845 | 5/1933 | Macrae et al. | 123/41.15 |
| 2,428,373 | 10/1947 | Lloyd | 123/41.15 X |
| 2,537,694 | 1/1951 | Oaks | 123/41.51 X |
| 3,132,634 | 5/1964 | Butler | 123/41.51 X |
| 3,162,183 | 12/1964 | Gratzmuller | 123/41.08 |
| 3,229,456 | 1/1966 | Gratz | 123/41.15 X |

FOREIGN PATENT DOCUMENTS

| | | | |
|---|---|---|---|
| 805204 | 12/1958 | United Kingdom | 440/88 |

*Primary Examiner*—Tony M. Argenbright
*Assistant Examiner*—Eric Carlberg
*Attorney, Agent, or Firm*—Marmorek Guttman & Rubenstein

[57] ABSTRACT

A cooling system for water-cooled internal combustion engines, particularly boat motors comprises a pump for circulating cooling water over a heat exchanger and through an expansion vessel, a raw water pump for maintaining a flow of raw water as a cooling fluid through the heat exchanger, a reservoir, and a pressure relief valve and a check valve which are connected in parallel between the expansion vessel and the reservoir. In order to reliably maintain a high pressure in the expansion vessel and to maintain an emergency operation in case of a leak in the cooling system and to accomplish this with simple means, the reservoir is pressure-tight, the line which connects the expansion vessel to the reservoir opens into the uppermost portion of the reservoir, and the raw water pump is connected by a discharge line to the lowermost portion of the reservoir.

3 Claims, 1 Drawing Sheet

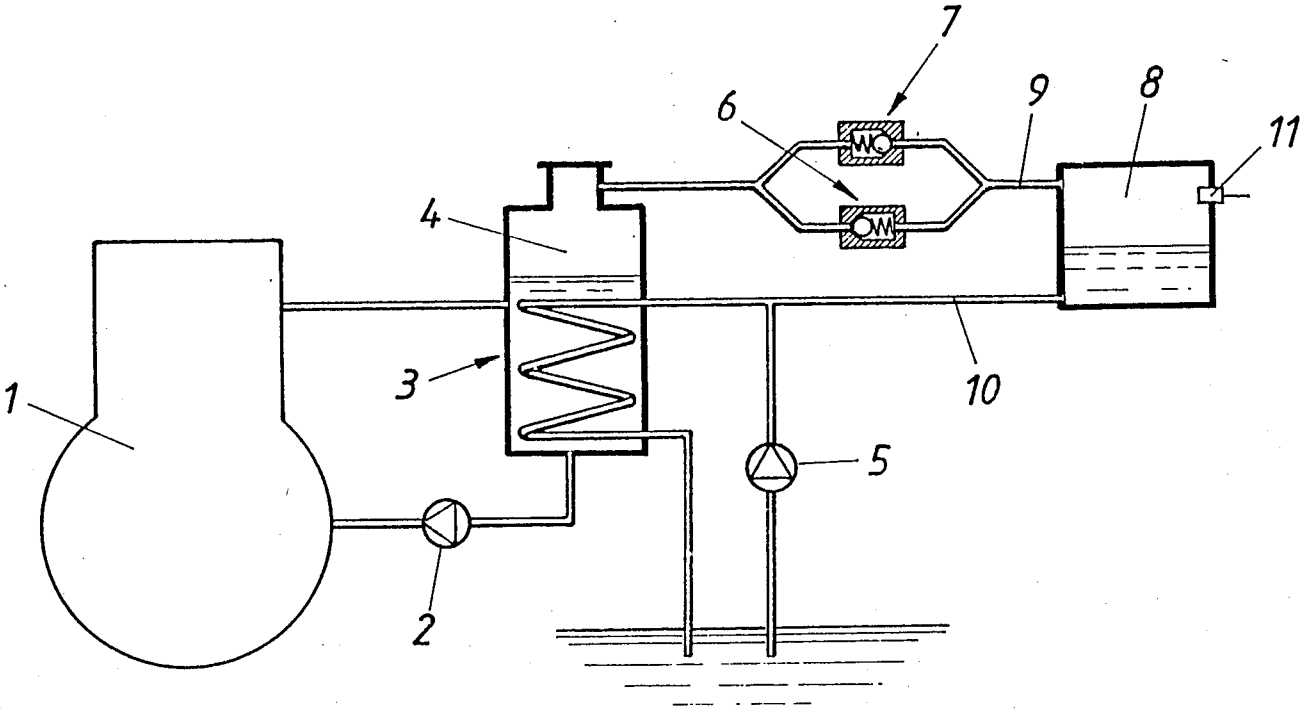
11
8
9
7
6
10
5
4
3
2
1

COOLING SYSTEM FOR A WATER-COOLED INTERNAL COMBUSTION ENGINE

BACKGROUND OF THE INVENTION

1. Field of the Invention

This invention relates to a cooling system for water-cooled internal combustion engines, particularly for boat motors, which system comprises a pump for circulating cooling water over a heat exchanger and through an expansion vessel, a raw water pump for maintaining a flow of raw water as a cooling fluid through the heat exchanger, a reservoir, and a pressure relief valve and a check valve which are connected in parallel between the expansion vessel and the reservoir.

2. Description of the Prior Art

In known cooling systems of that kind the reservoir constitutes an overflow vessel. When a temperature rise of the cooling water causes the pressure in the expansion vessel to rise above a predetermined value, water and/or steam will be displaced from the expansion vessel into the reservoir. On the other hand, water will flow back from the reservoir into the expansion vessel in response to a temperature drop of the cooling water. But it is generally desirable to operate the cooling water circuit under a high pressure because this will obviously increase the boiling point of the cooling water, which in that case can assume a higher temperature so that the heat exchanger and also the pump for raw water may be designed with smaller dimensions. Besides, the cavitation in the circulating pump and in the engine will be reduced and the higher temperature level will result in a higher efficiency of the engine. In the known system a higher pressure in the expansion vessel and in the entire cooling water circuit cannot reliably be achieved. This is due to the fact that when a high load on the engine has resulted in a temperature rise of the cooling water and a corresponding pressure rise in the expansion vessel and a corresponding quantity of cooling water has been displaced from the expansion vessel into the reservoir and if then a temperature drop occurs in the heat exchanger and/or in the expansion vessel for any reason whatever, cooling water will be sucked back from the reservoir into the expansion vessel and that operation will result in a high pressure drop in the expansion vessel. Such a pressure drop may also occur, for instance, if the quantity of water contained in the cooling circuit is inherently insufficient or if a leak occurs in the cooling circuit. In case of a leak which is so large that the quantity of cooling water decreases below a predetermined lower limit, the engine must be shut down if heavy damage to the internal engine is to be avoided. The failure of the motor a boat on the high seas may involve a high risk for the boat and its crew, particularly because it is very difficult to continually fill up the system with cooling water on a heavy sea.

SUMMARY OF THE INVENTION

It is an object of the invention to eliminate the disadvantages stated hereinbefore and to provide a cooling system which is of the kind described first hereinbefore and in which a relatively high pressure in the expansion vessel can be ensured with simple means and an emergency operation of the cooling system can be maintained.

That object is accomplished in accordance with the invention in that the reservoir is pressure-tight, the line which connects the expansion vessel to the reservoir opens into the uppermost portion of the reservoir, and the raw water pump is connected by a discharge line to the lowermost portion of the reservoir.

Because the reservoir is pressure-tight and communicates through the discharge line with the raw water pump, the reservoir constitutes a surge chamber by which the pressure which under the control of the raw water pump exists in the expansion vessel and in the entire cooling water circuit is maintained. When the pressure in the expansion vessel rises above the pressure which is set by the pressure relief valve, the level of the raw water in the reservoir will be depressed against the discharge pressure of the raw water pump. Substantial leakage losses from the cooling circuit will not result in a pressure drop in the expansion vessel because in that case the raw water level in the reservoir can rise correspondingly and the reservoir communicates through the check valve with the expansion vessel. Even in case of substantial damage to the cooling circuit the operation of the engine can be continued because the cooling circuit will then continuously be supplied with water, even through it is raw water, through the reservoir and the expansion vessel. Whereas raw water will be deleterious to the engine it can well be used for a limited time in an emergency.

Within the scope of the invention the reservoir is provided with a liquid level detector which generates a signal in response to a rise of the raw water level in the reservoir to a predetermined upper limit. That signal will be generated before raw water can enter the communicating line between the reservoir and the expansion vessel and before the cooling water level in the expansion vessel has fallen to a critical lower limit and said signal will indicate to the operator that make-up water must be supplied into the expansion vessel if a mixing of cooling water and raw water is to be avoided. The signal is suitably continued until the raw water level in the reservoir has dropped or a measure taken for effecting such a drop of the water level has been successful. If a mixing of cooling water and raw water has already taken place, the cooling water will have to be replaced before the normal operation is resumed.

BRIEF DESCRIPTION OF THE DRAWING

The drawing is a diagrammatic representation of an illustrative embodiment of a cooling system in accordance with the invention.

DETAILED DESCRIPTION OF THE PREFERRED EMBODIMENT

Cooling water used to cool an internal combustion engine 1, which consists, e.g., of a boat motor, is circulated by a pump 2 over a heat exchanger 3 and through an expansion vessel 4. A raw water pump 5 supplies raw water as a cooling fluid to the heat exchanger 3. The expansion vessel 4 communicates with a reservoir 8 through a pressure relief valve 6 and a check valve 7 connected in parallel. The reservoir 8 is pressure-tight. The communicating line 9 coming from the expansion vessel 4 opens into the uppermost portion of the reservoir 8. A discharge line 10 leads from the raw water pump 5 into the lowermost portion of the reservoir 8. The reservoir 8 contains a liquid level detector, which generates a visual signal and/or an audible signal in response to a rise of the raw water level in the reservoir 8 to a predetermined limit.

I claim:

1. In a cooling system for a water-cooled internal combustion engine, comprising a cooling circuit including an expansion vessel and a cooling water pump for circulating cooling water in said cooling circuit through said expansion vessel, a reservoir, a communicating line connecting said expansion vessel and said reservoir and incorporating a pressure relief valve and a check valve connected in parallel, a heat exchanger for cooling said cooling water in said cooling circuit, and a raw water pump for maintaining a flow of raw water through said heat exchanger, the improvement residing in that said reservoir is pressure-tight, said communicating line opens into said expansion vessel adjacent to its top and into said reservoir adjacent to its top, and a discharge line from said raw water pump opens into said reservoir adjacent to the bottom thereof.

2. The improvement set forth in claim 1 as applied to a cooling system for a boat motor.

3. The improvement set forth in claim 1, wherein a liquid level detector is arranged in said reservoir and is responsive to a rise of the raw water level in said reservoir to a predetermined upper limit below the level at which said communicating line opens into said reservoir.

* * * * *